US005453034A

United States Patent [19]

Larws

[11] Patent Number: 5,453,034

[45] Date of Patent: Sep. 26, 1995

[54] PLUG-IN MODULE AS A COMPONENT OF A TOY BUILDING BLOCK SYSTEM

[75] Inventor: Peter Larws, Usingen, Germany

[73] Assignee: Palimondial S.A., Brasseur, Luxembourg

[21] Appl. No.: 103,173

[22] Filed: Aug. 6, 1993

Related U.S. Application Data

[63] Continuation of Ser. No. 814,106, Dec. 26, 1991, abandoned.

[30] Foreign Application Priority Data

Dec. 28, 1990 [DE] Germany ..... 40 41 953.3
Jan. 22, 1991 [DE] Germany ..... 41 01 756.0

[51] Int. Cl.[6] ..... A63H 33/08

[52] U.S. Cl. ..... 446/103; 446/120

[58] Field of Search ..... 446/102, 103, 446/120, 121, 124, 125, 128, 118

[56] References Cited

U.S. PATENT DOCUMENTS

| | | | |
|---|---|---|---|
| 3,224,135 | 12/1965 | Wright et al. | 446/121 X |
| 3,566,531 | 3/1971 | Hasel et al. . | |
| 4,106,657 | 8/1978 | Dogliotti | 446/121 X |
| 4,385,467 | 5/1983 | Samuels . | |
| 4,789,369 | 12/1988 | Lyman | 446/120 X |
| 4,813,903 | 3/1989 | Furukawa et al. . | |

FOREIGN PATENT DOCUMENTS

| | | | |
|---|---|---|---|
| 128398 | 9/1945 | Australia | 446/128 |
| 514062 | 12/1978 | Australia . | |
| 327752 | 2/1976 | Austria . | |
| 1868650 | 11/1962 | France . | |
| 814054 | 9/1951 | Germany . | |
| 765167 | 11/1962 | Germany . | |
| 1202694 | 10/1965 | Germany . | |
| 76418 | 9/1970 | Germany . | |
| 1915991 | 10/1970 | Germany . | |
| 8205825 U | 10/1982 | Germany . | |
| 3223806 | 1/1983 | Germany . | |
| 2920743 | 3/1983 | Germany . | |
| 1382134 | 1/1975 | United Kingdom . | |
| 2098495 | 11/1982 | United Kingdom . | |
| 2185192 | 7/1987 | United Kingdom . | |
| 2231502 | 11/1990 | United Kingdom . | |

*Primary Examiner*—Michey Yu
*Attorney, Agent, or Firm*—Barnes & Thornburg

[57] ABSTRACT

A plug-in module is described; one side of this incorporates four spring leaves (6, 6') that can be deflected slightly outwards and which are arranged on one side in a tulip shape and which, on the other five sides surfaces (2 to 5), can be snapped onto a similarly constructed plug-in module. The side surfaces incorporate ridges (8, 8') which can be either continuous or segmented. On their inner sides, the spring leaves are provided with corresponding connecting elements (7, 7', 7") which snap behind the ridges described above. The production of a connection between two plug-in modules is effected first by a slight outward deflection of the spring blades from their rest position and by them subsequently snapping into position behind the ridges described above. The plug-in modules entail the advantage that even after a long time and frequent use, they can still be connected to each other easily or released from each other with equal ease.

28 Claims, 7 Drawing Sheets

PLUG-IN MODULE AS A COMPONENT OF A TOY BUILDING BLOCK SYSTEM

BACKGROUND AND SUMMARY OF THE INVENTION

The present invention relates to a plug-in module that is part of a toy building block set which can be releaseably attached to one or a plurality of plug-in blocks that make up the construction set.

Cubic toy building blocks that can be plugged into each other are known; these can be plugged together by means of connecting buttons on the side surfaces, the snap connection always being effected with circular buttons and appropriately formed holes in the opposite piece.

Such systems entail the following serious disadvantages:

1. The side surfaces of the cube are not continuous, but are interrupted by holes that are used to accommodate the plug-in buttons, which detracts from their appearance and results in unrealistic models. For this reason, in these known systems, the models that are produced are frequently covered with continuous covering surfaces to which, however, nothing else can be plugged in.
2. The buttons for connecting the parts together are difficult to manipulate when the parts are new and subsequently, after a long period of use, they become loose, so that the pleasure they provide remains limited.

DE-AS 1202694 describes a hollow box-like toy construction element which, on one side, has a row of snap buttons, onto which the side walls of a plug-in element that is installed above them are intended to snap into place. Thus, it is only possible to join one construction element to another on the side that incorporates these snap buttons. Furthermore, it is difficult to bring two adjacent construction elements into the snap position, because the side walls of the two plug-in elements that are adjacent to each other hinder each other during the deflection that is required in order to make the connection.

DE 2920743 C2 describes modules of a construction set. This module is in the form of a hollow cube that is open on one side, which has on its upper side that is opposite the open side of the cube, and on the other side walls, a square connector pin that is arranged centrally. The connector pins are so dimensioned that the open side of the module. A firm connection can only be achieved by means of additional connecting elements. This is a particular disadvantage.

In the same way, DE 1868651 01 describes an element, which is, for example, a cube, and which has snap elements that are intended to be joined to the opposing pieces of a corresponding module. Snap elements in the form of small balls on the corners of a connecting pin are pressed into correspondingly shaped corners in the inside of another element. The plastic deformation that this causes results in material fatigue, and this is detrimental to the long-term use of the module.

AT-PS 327725 shows parts of a construction set of which two-part foldable construction elements are assemblable by producing a snap connection. In order to break this snap connection, it is necessary to squeeze the side walls of the module together. Furthermore, it is not possible to join other modules to the side surfaces that have to be pressed together in order to break the snap connection. A similar idea is described in DD-PS 76418.

It is the task of the invention that is described below to create a plug-in module, with which the above-discussed disadvantages are avoided, and with which the user has the added advantage that he can plug a module onto several surfaces on another module. This results in a considerable increase in its play value.

The result is a plug-in module, one side of which incorporates four slightly springy connectors in a tulip-shaped arrangement, which are in the form of spring leaves that extend outwards from the body of the plug-in module and which can snap onto the other five closed side surfaces of a similarly constructed plug-in module. The closed side surfaces have at least two preferably opposing strips and, at most, four ridges that can snap into the spring leaves of another plug-in cube.

SUMMARY OF THE INVENTION

The configuration according to the present invention ensures that if the surfaces are clean, the connection will not wear and will function throughout the whole life of the component parts.

When the connection is made, the spring leaves of the connectors that are arranged in the tulip shape flex in and out within the limits of the elastic deformation of the plastic, and thus work without becoming fatigued. According to a preferred embodiment, the spring leaves are moulded onto the body of the plug-in module and are offset such that in their position of maximum outward deflection, which is to say when the connection is being made, they do not move beyond the outermost limits of the plug-in module. This prevents a module that has already been connected to a plug-in module from interfering with a plug-in module that is to be joined in the immediate vicinity, for its spring blades still have sufficient room to move.

This means that multi-sided designs can be assembled from a plurality of identical parts and have surfaces that, visually speaking, are almost continuous, although additional elements can be joined to them at any time.

In other advantageous applications, the plug-in module according to the present invention makes it possible to accommodate a reduction or step-up gearing in its interior, so that numerous gear combinations can be assembled for use during play, as well as for industrial applications.

To this end, as an example, in the area of the four slightly springy spring leaves of a plug-in element, there is a shaft with a section of a dog clutch. In the side surfaces of the other plug-in element that is to be joined to this plug-in element there are openings, through which pass the other elements of the dog clutch that engage in each other through shafts and pinions which form the gear train (transmission). When the snap connection between two plug-in elements that are developed in this way is produced, one part of the dog clutch on the shaft of the gear train within the first plug-in element engages in or through the other part of the dog clutch on the shaft of the gear train in the other plug-in element in such a way that a driving force can be transmitted between the two gear trains.

If a bevel gear is incorporated in a plug-in module that has openings in the side surfaces at 90°, 180°, and 270° relative to the axis of the snap connector, variously configured drive trains can be constructed, and these can be connected, for example, to an electric motor.

A plug-in module that is incorporated in a drive train preferably incorporates an internal slip coupling or clutch in order to prevent the motor being overloaded in the event of the gear train becoming locked up.

BRIEF DESCRIPTION OF THE DRAWINGS

The present invention will be described in greater detail below on the basis of the drawings appended hereto. These drawings show the following.

DETAILED DESCRIPTION OF THE DRAWINGS

Figure 1:
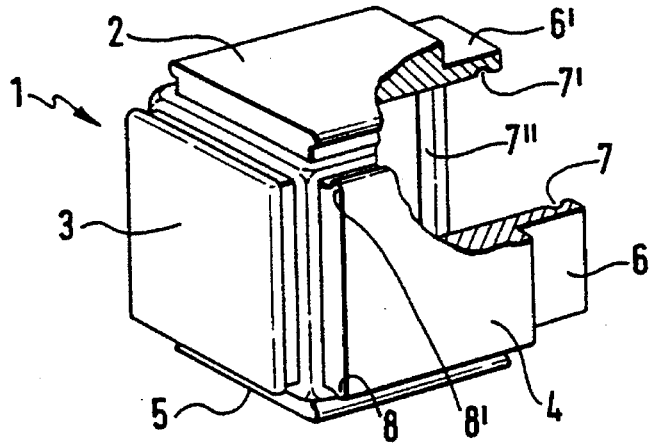
FIG. 1 is a cubic plug-in module according to the present invention.

FIG. 1 shows a cubic body 1 according to the present invention, with closed in plug-in surfaces on five sides, of which, in FIG. 1, four such surfaces are numbered 2 to 5; this figure also shows, in partial cross section, the four-bladed tulip-shaped connectors in the form of spring leaves 6, 6' on the sixth side of the cube 1. The grooves 7, 7', 7" of the spring blades 6, 6' snap into the ridges 8, 8' on the closed plug-in surfaces 1 of a similarly constructed cube. To this end, the four spring elements 6, 6' of a cube 1 are guided onto a plug-in surface 2 to 5 of another cube. When acted upon by force, the spring leaves flex outwards and the grooves 7 to 7" snap into the ridges 8, 8' when they reach the end position. The cubes are separated in the reverse order.

Figure 2:
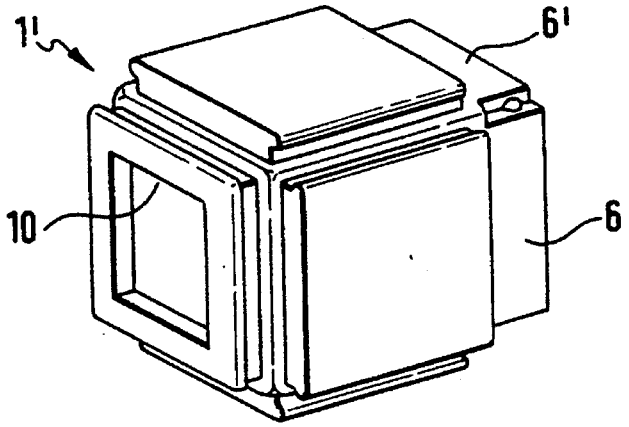
FIG. 2 is one version of the plug-in module shown in FIG. 1.

FIG. 2 shows one variation of the plug-in module 1' shown in FIG. 1, with a central square opening 10 on the side that is opposite to the four-leaf connector.

Figure 3:
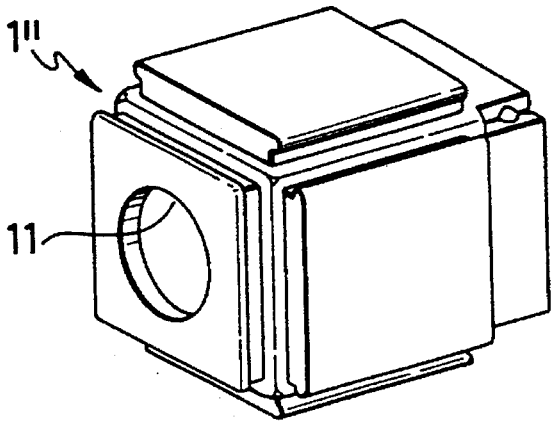
FIG. 3 is a further version of the plug-in module shown in FIG. 1.

FIG. 3 shows a further variation of a cube 1" with a central circular opening 11 on the side that is opposite the four-leaf connector.

Figure 4:
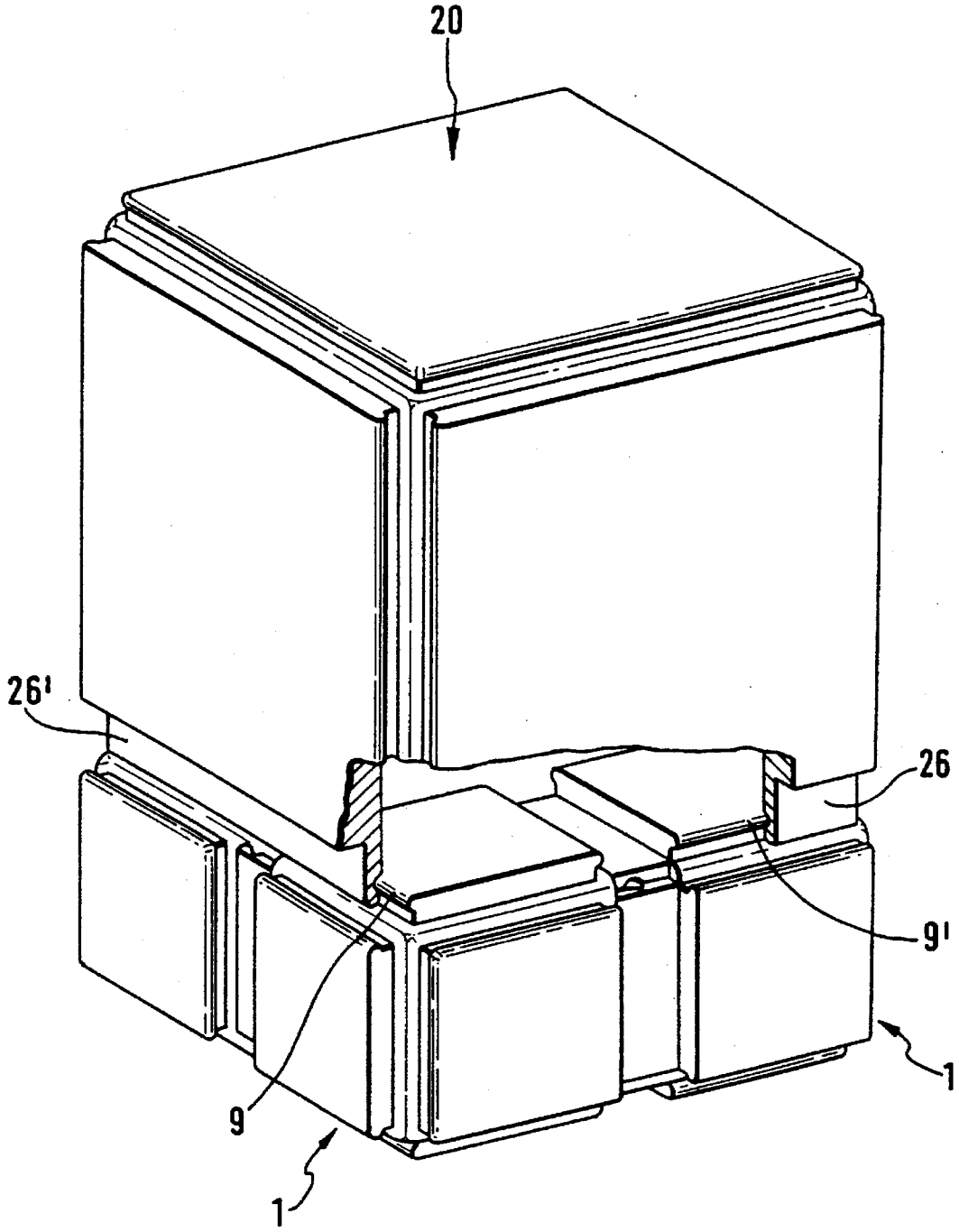
FIG. 4 is an arrangement of a large plug-in module according to the present invention, connected with four small plug-in modules.

Compared to all formerly known systems, a great advantage of the configuration of the cubic plug-in module according to the present invention is that larger versions of the cubic plug-in module can be snapped together with two or more smaller versions (see FIG. 4). The spring leaves 26, 26' of the larger cube 20 snap over the ridges 9, 9' of the smaller cube 1. In this connection, it is not absolutely essential that the larger version is a cube; it can also be rectangular (e.g., so that it snaps over two or six of the smaller cubic blocks).

Figure 5:
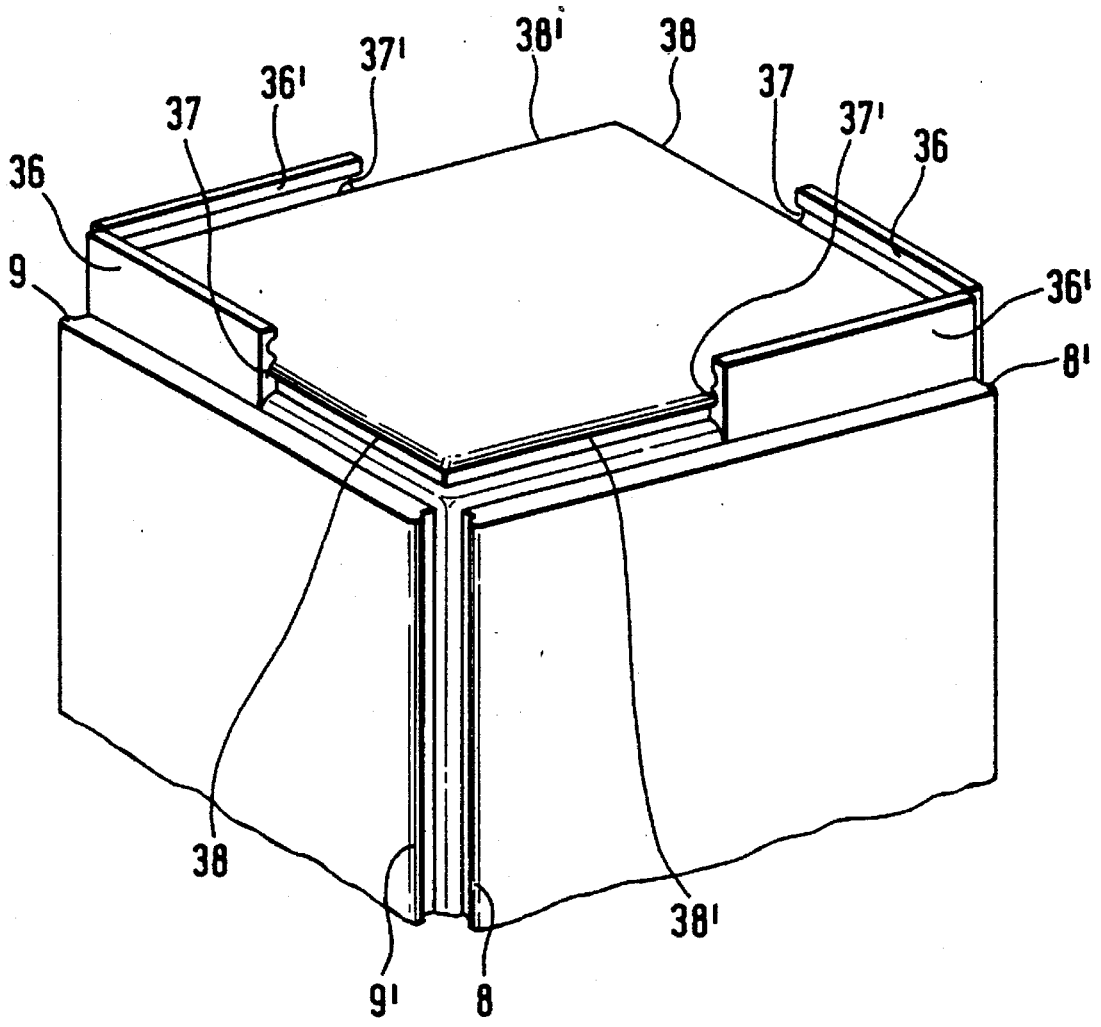
FIG. 5 is a further embodiment of the plug-in module, in partial cross section.
Figure 11:
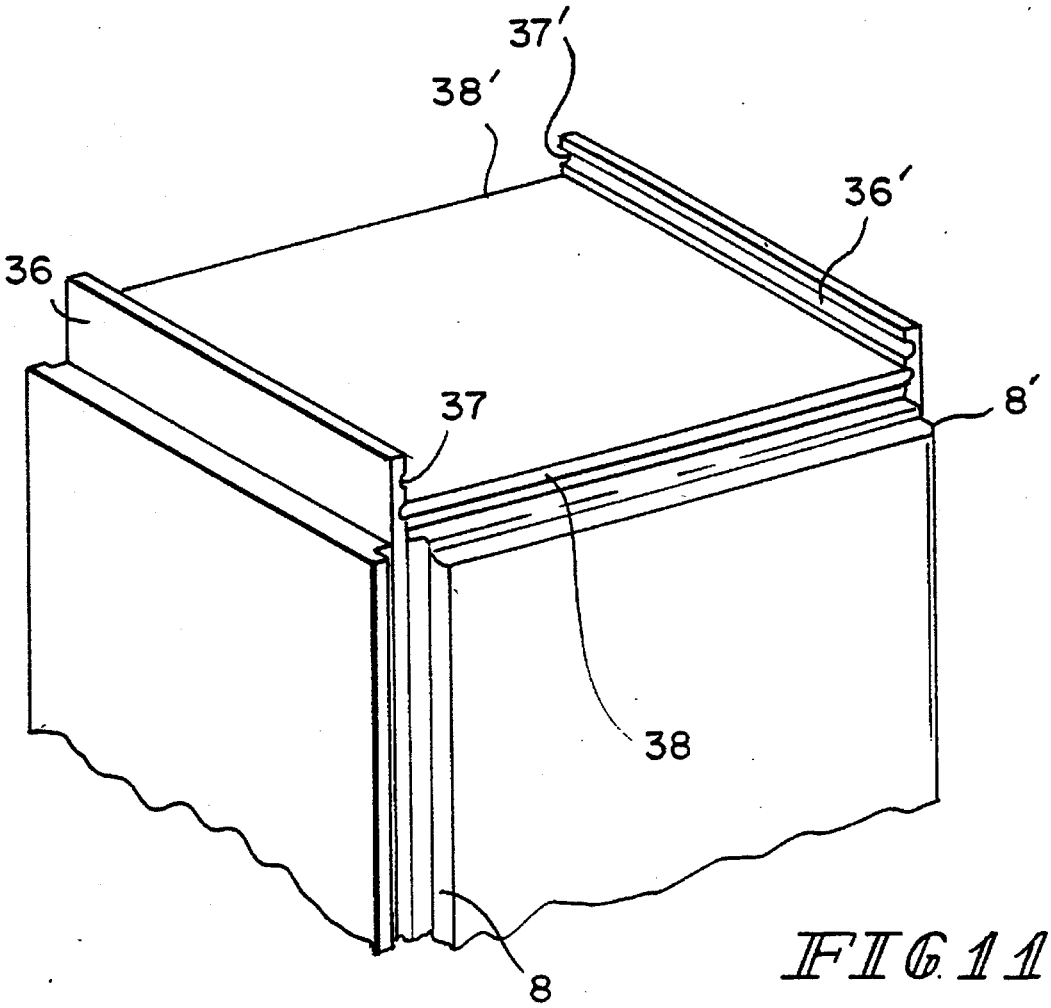
FIG. 11 is a further embodiment showing a plug-in module with plural fingers and ridges on a side.

FIG. 5 shows a further version of the plug-in module according to the present invention. Here, snap ridges 8, 8', 9, 9' are moulded onto all of the side edges of the side surfaces with the exception of one. However, on one side surface there are snap ridges 38, 38', although these are such that they do not extend to the whole length of the side edges. On the remaininr section of the side edges there is, in each instance, a spring leaf 36, 36'. These incorporate grooves 37, 37', which snap into position in the snap ridges 8, 8', 9, 9'; 38, 38' in the manner described above. FIG. 11 shows a modification with two fingers 36, 37 on one side, two fingers 36', 37' on an opposite side and plural snap ridges 38, 38' on the opposing two sides.

The above-described embodiment means that the sides of the plug-in module that bear the spring leaves can also be joined to each other.

The present invention is not confined such that the grooves and snap ridges of the plug-in modules must be configured so as to be continuous.

Figure 6:
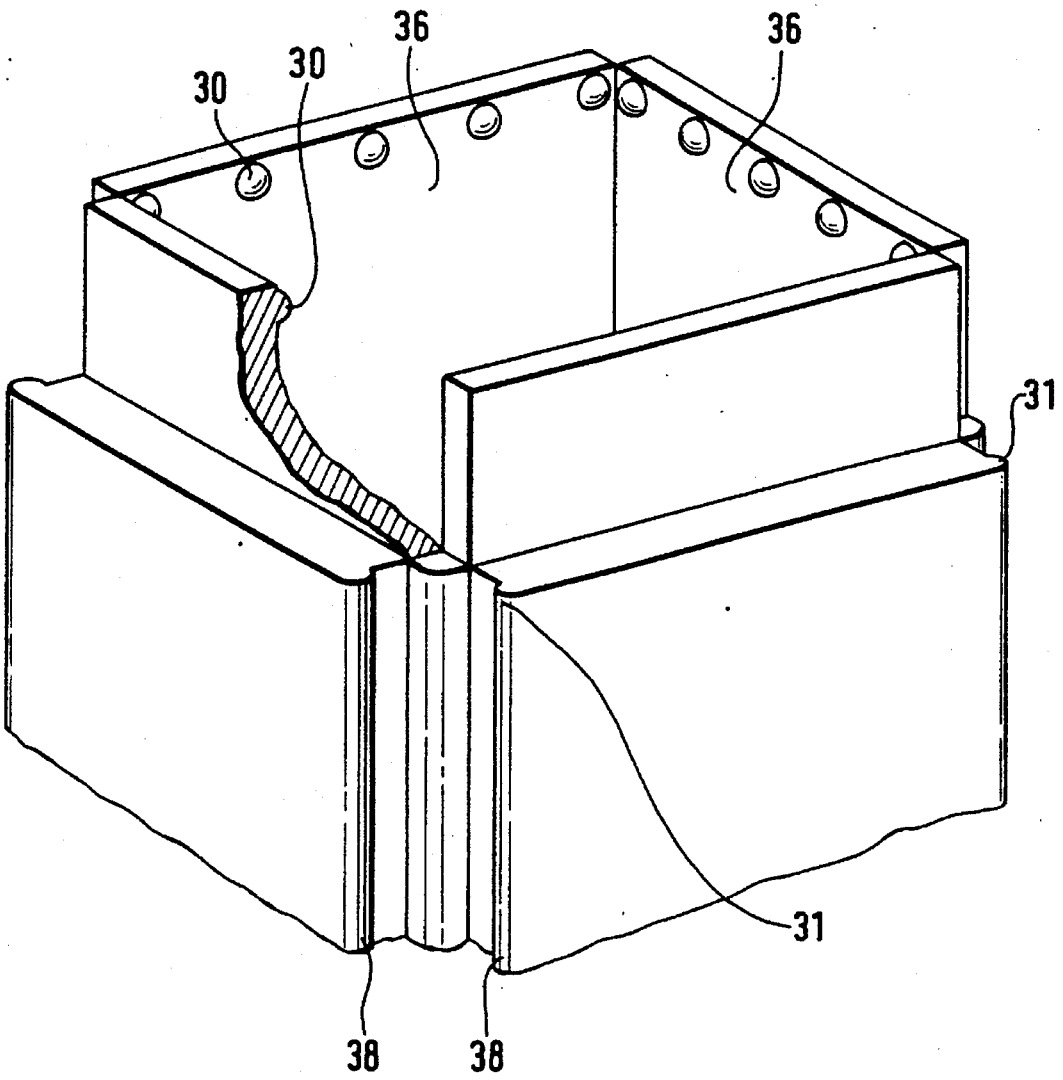
FIG. 6 is a further embodiment, in partial cross section.

Thus, FIG. 6 shows a plug-in module in which a row of buttons or knobs 30 are moulded onto the inner side of the spring blades 36. In the embodiment shown, the buttons 30 are hemispherical. Conical, pyramidal, or pointed configurations, not shown herein, can also be used.

On the closed side surfaces, the plug-in module shown in FIG. 6 incorporates snap ridges 38, with which the connection between the spring blades 36 and the buttons 30 can be produced.

Figure 7:
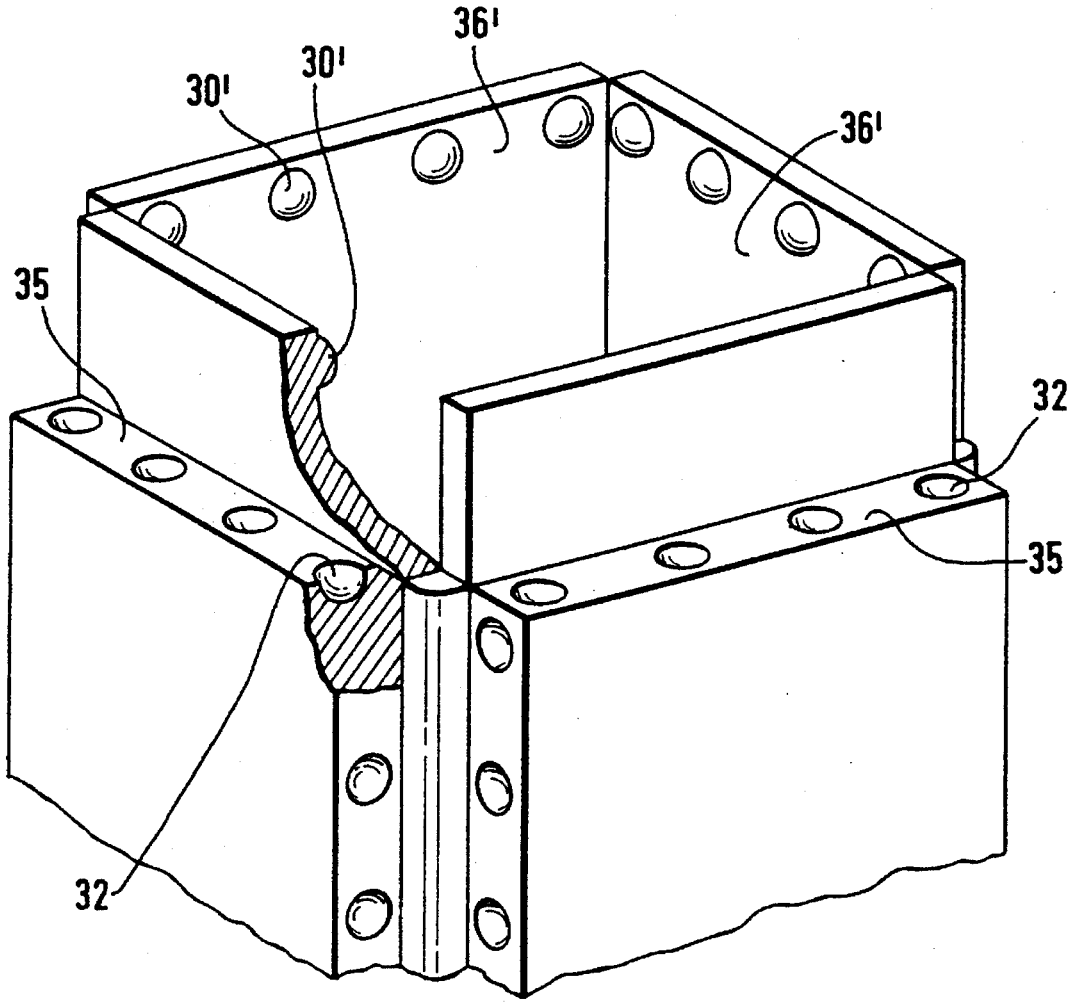
FIG. 7 is still another embodiment of the plug-in module, in partial cross section.

FIG. 7 shows a further embodiment with buttons 30' that are arranged in a row on the inner side of the spring leaves 36'. On the face sides 35 of the side surfaces there are recesses 32 that are of a shape that is complementary to each of the buttons 30' and arranged in the same pattern as these buttons 30'. When the connection between two plug-in modules of this kind is produced, the spring leaves 36 first spring slightly outwards, afterwards which the buttons 30' snap into the recesses 32.

All of the embodiments that are shown have spring leaves (6, 6'; 26, 26'; 36, 36') that are formed so as to be offset inwards from the edge of the cube. The extent of this offset is so selected that when they are deflected maximally outwards, when a connection is being made with another plug-in module, they do not move beyond the outermost limits of the module. This means that two (or more) plug-in modules can be installed next to each other on a larger module without the outermost shape of one module hindering the outward deflection of the spring leaves of the other module.

Common to all the embodiments shown is that the material used for the plug-in modules returns, for all practical purposes, to an unstressed or unloaded state once the connection has been made. The material is only stressed when the spring leaves are flexed outwards from their resting position in order to produce or release the connection to another module.

Figure 8:
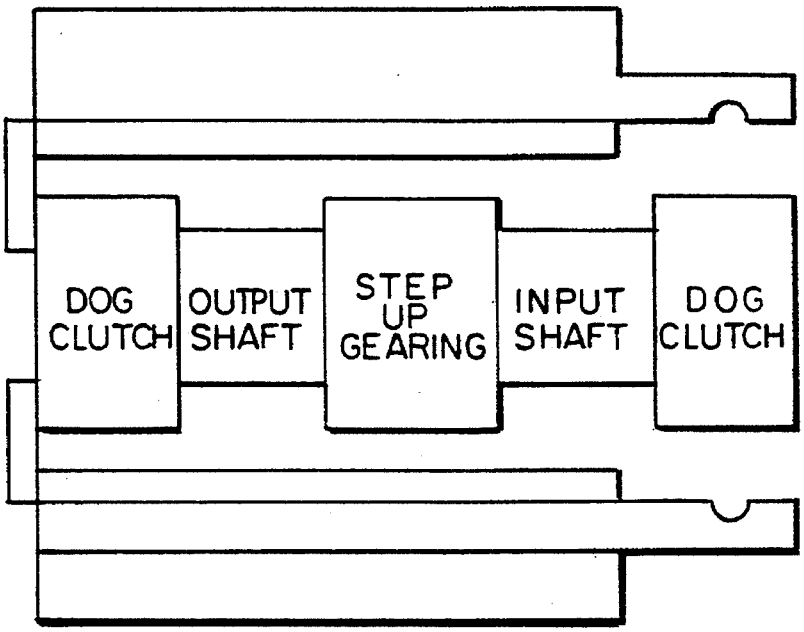
FIG. 8 is a diagrammatic view of a plug-in module that incorporates a step-down or step-up gear train with an input at 0° and an output at 180°.
Figure 9:
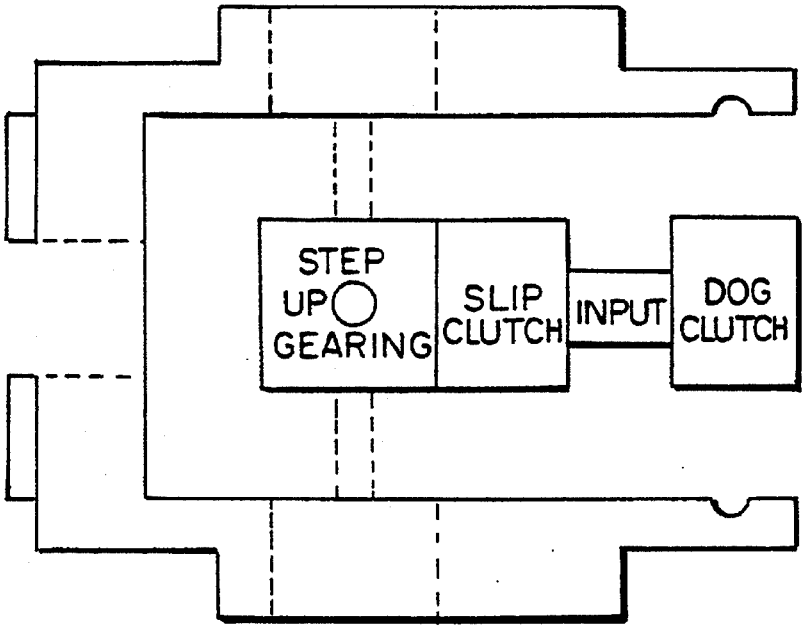
FIG. 9 is a schematic view of a plug-in module with a bevel gear, with the input at 0°, and outputs at 90°, 180°, and 270°.
Figure 10:
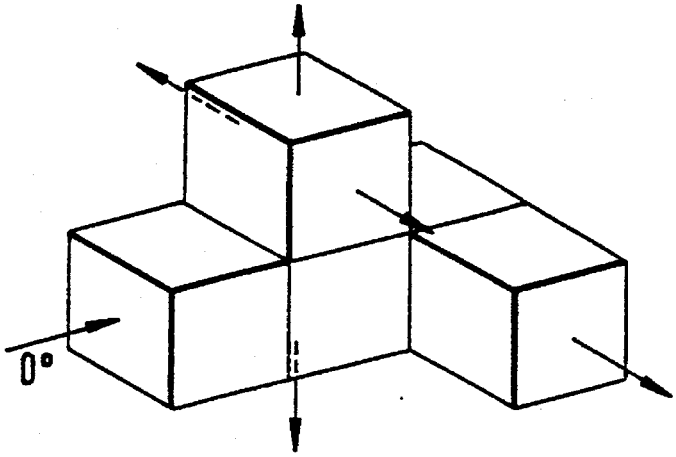
FIG. 10 is a schematic view of a series of plug-in modules that are joined together and which incorporate various types of gearing.

FIGS. 8 to 10 show advantageous embodiments of the plug-in module that incorporate a gear train or a step-down, step-up, or angle drive in their interiors. For purposes of clarity, the spring leaves that are always present on each plug-in module, as described above, have been omitted from FIG. 10. They are formed on the side which in each instance is designated "input 0°". On this FIGS. 8 and 9 show (in section) therefore a dog clutch which, when plugged into the other plug-in module, will form a power transmission coupling with the other element of the dog clutch in another plug-in module. These opposite members are accessable from the outside on the sides that are marked output, through openings made in the side surfaces.

FIG. 10 is a diagrammatic representation of a drive train in which a plug-in module is joined to one plug-in module with the input at 0°, to which three further plug-in modules are coupled, etc.; thus, it is clear that any form of drive train can be constructed by using this embodiment.

I claim:

1. A plug-in module as part of a toy construction set, which can be releasably connected to one or a plurality of plug-in modules of the set, the plug-in module including a plurality of relatively rigid side surfaces, each having at least four side edge surface, a snap ridge (8, 8', 9, 9') formed on at least one of the at least four side edge surfaces of one of the rigid side surfaces of the plug-in module, plural separate flexible spring leaves (6, 6'; 26, 26') provided with grooves (7, 7', 7"), one leaf formed on at least one other of the side edge surfaces of the one rigid side surfaces and another leaf formed on a side edge surface of another rigid side surface, and which plural separate spring leaves are recessed inwardly from an outer portion of their respective rigid side surfaces to extend from the plug-in module with sufficiently flexibility in themselves to allow the snap ridges (8, 8', 9, 9') of another plug-in module to be brought into a connected position with the grooves by initial spring deflection of the spring leaves (6, 6'; 26, 26') and their subsequent return to the undeflected condition after passage over the snap ridges and without requiting significant deflection of the side surfaces, and wherein the plural separate flexible spring leaves are recessed inwardly from the outer portion of the side surfaces by a sufficient mount so when there is a maximum deflection of the plural separate spring leaves of one plug-in module the spring leaves pass over the snap ridges on another plug-in module and wherein said maximum deflection does not extend the plural separate spring leaves beyond the outer portion of the side surfaces to thus permit two plug-in modules to be connected by passing the plural separate spring leaves of one module over the snap ridges of another module without removal of any other module that would otherwise be necessary if the spring leaves in deflected condition extended beyond the outer portion of said side surfaces of a plug in module.

2. A plug-in module as defined in claim 1 wherein the snap ridges (8,8', 9, 9') are provided on at least two of the at least four side edge surfaces of said one of the rigid side surfaces (2 to 5).

3. A plug-in module as defined in claim 2 wherein a snap ridge (8, 8', 9, 9') is provided on each side edge surface of at least one of the plurality of the rigid side surfaces (2 to 5).

4. A plug-in module as defined in claim 3 wherein the plurality of spring leaves oppose one another.

5. A plug-in module as defined in claim 2, wherein there are two spring leaves that extend in a single direction and oppose one another across a side surface of the plug-in module (1;20).

6. The plug-in module of claim 5 wherein snap ridges are located adjacent the other side surface containing the opening for the output shaft.

7. A plug-in module as defined in claim 2, wherein the plural spring leaves oppose one another and extend outwardly from the plug-in module in the same direction, and with the plug-in module including an interior, the interior of the plug-in module incorporating a gear train including a drive shaft, the drive shaft being accessible on a first of the plurality of rigid side surfaces of the plug-in module, that is located between two of the at least two spring leaves, the drive shaft being provided with a first element of a dog clutch; the gear train incorporating at least one output shaft, the output shaft being accessible through an opening provided in another side surface of the plug-in module, from the outside, and the output shaft being provided with the other element of the dog clutch, this other element of the dog clutch being connected with the first element of the dog clutch of another such plug-in module when the snap connection is made between the plug-in modules, so as to produce a force-transmitting connection.

8. The plug-in module of claim 7 wherein snap ridges are located adjacent the other side surface containing the opening for the output shaft.

9. A plug-in module as defined in claim 3, wherein the plural spring leaves oppose one another and extend outwardly from the plug-in module in the same direction, and with the plug-in module including an interior, the interior of the plug-in module incorporating a gear train including a drive shaft, the drive shaft being accessible on a first of the plurality of rigid side surfaces of the plug-in module, that is located between two of the at least two spring leaves, the drive shaft being provided with a first element of a dog clutch; the gear train incorporating at least one output shaft, the output shaft being accessible through an opening provided in another side surface of the plug-in module, from the outside, and the output shaft being provided with the other element of the dog clutch, this other element of the dog clutch being connected with the first element of the dog clutch of another such plug-in module when the snap connection is made between the plug-in modules, so as to produce a force-transmitting connection.

10. The plug-in module of claim 9 wherein snap ridges are located adjacent the other side surface containing the opening for the output shaft.

11. A plug-in module as defined in claim 1 including an interior, the interior of the plug-in module incorporating a gear train including a drive shaft, the drive shaft being accessible adjacent a first side surface of the plug-in module provided with a spring leaf, the drive shaft being provided with a first element of a dog clutch; the gear train incorporating at least one output shaft, the output shaft being accessible through an opening provided in another side of the plug-in module, from the outside; and the output shaft being provided with the other element of the dog clutch, this other element of the dog clutch being connected with the first element of the dog clutch of another such plug-in module when the snap connection is made between the plug-in modules, so as to produce a force-transmitting connection.

12. A plug-in module as defined in claim 11 wherein the gearing of said gear train is a step-up gearing.

13. A plug-in module as defined in claim 11 wherein the gearing of said gear train is an angle drive with three of said output shafts.

14. A plug-in module as defined in claim 11 wherein the gear train further comprises a slip coupling or clutch between the input shaft and the output shaft of the gear train.

15. A plug-in module as defined in claim 12 wherein the gear train further comprises a slip coupling or clutch between the input shaft and the output shaft of the gear train.

16. A plug-in module as defined in claim 13 wherein the gear train further comprises a slip coupling or clutch.

17. The plug-in module of claim 12 wherein snap ridges are located adjacent the other side surface containing the opening for the output shaft.

18. The plug-in module of claim 13 wherein snap ridges are located adjacent the other side surface containing the opening for the output shaft.

19. The plug-in module of claim 14 wherein snap ridges are located adjacent the other side surface containing the opening for the output shaft.

20. The plug-in module of claim 15 wherein snap ridges are located adjacent the other side surface containing the opening for the output shaft.

21. The plug-in module of claim 16 wherein snap ridges are located adjacent the other side surface containing the opening for the output shaft.

22. The plug-in module of claim 11 wherein snap ridges are located adjacent the other side surface containing the opening for the output shaft.

23. A plug-in module as part of a toy construction set, which can be releasably connected to one or a plurality of plug-in modules of the set, the plug-in module including a plurality of relatively rigid side surfaces, each side surface having an outwardly facing surface, at least four side edge surfaces, and a snap ridge (38) that is formed on some of the at least four side edge surfaces of one of the rigid side surfaces of the plug-in module, plural separate flexible spring leaves (36), one leaf formed on at least one other of said at least four side edge surfaces said one rigid side surface and recessed from the outwardly facing surface of the one rigid side surface to extend from the plug-in module and another leaf formed on a side edge surface of another rigid side surface and recessed from the outwardly facing surface of said another of said rigid side surface.

the spring leaves incorporating buttons (30) that protrude on a side of the leaves that faces away from the outwardly facing side surfaces from which they are recessed and which, after initial outward deflection of the plurality of independent flexible spring leaves (36) to produce a connection with another plug-in module return to undeflected condition, snapping behind these snap ridges (38), wherein the plural flexible spring leaves are recessed from their respective rigid one and another side surfaces of the plug-in module a sufficient distance to have a position of maximum outward deflection so as to ride over the snap ridges of the another plug-in module, and wherein said maximum deflection does not extend the spring leaves outwardly past the outwardly facing surfaces of the one and another rigid side surface of the plug-in module due to the recessing of the leaves so as to permit a module to be connected to any other module of a set of modules, without removal of any module that would otherwise be necessary if the leaves were deflected past the side surface of a plug-in module.

24. A plug-in module as defined in claim 23, wherein the plural spring leaves oppose one another and extend outwardly from the plug-in module in the same direction, and with the plug-in module including an interior, the interior of the plug-in module incorporating a gear train including a drive shaft, the drive shaft being accessible on a first of the plurality of rigid side surfaces of the plug-in module, theft is located between two of the at least two spring leaves, the drive shaft being provided with a first element of a dog clutch; the gear train incorporating at least one output shaft, the output shaft being accessible through an opening provided in another side surface of the plug-in module, from the outside, and the output shaft being provided with the other element of the dog clutch, this other element of the dog clutch being connected with the first element of the dog clutch of another such plug-in module when the snap connection is made between the plug-in modules, so as to produce a force-transmitting connection.

25. The plug-in module of claim 24 wherein snap ridges are located adjacent the other side surface containing the opening for the output shaft.

26. A plug-in module as part of a toy construction set that can be releasably connected to one or a plurality of plug-in modules of the construction set, the plug-in module including at least four relatively rigid side surfaces having outwardly facing surfaces, each rigid side surface having at least four side edge surfaces with recesses (32) on at least one of the at least four side edge surfaces of one of the at least four rigid side surfaces, At least two separate flexible spring leaves (36), wherein each of the two leaves each extend from one of the at least four side edge surface of two of the rigid side surfaces respectively, the at least two flexible spring leaves (36) including buttons (30') that project on a side of the flexible spring leaves that faces away from the outwardly facing side surfaces of the two rigid side surfaces and which are formed so as to complement the recesses (32) adjacent a side edge surface of the rigid side surfaces of another such plug-in module and which, after an initial outward deflection of the flexible spring leaves (36') to produce the connection with such other plug-in module return to undeflected orientation with the buttons (30') of the first said plug-in module engaging the recesses (32) of such other plug-in module, wherein the flexible spring leaves are recessed by a sufficient distance from the outwardly facing surface of the side surfaces of the plug-in module to have a position of maximum outward deflection so as to have the buttons ride over the side edges, and wherein said maximum deflection does not extend the spring leaves outwardly past the outwardly facing surface of the two rigid side surfaces of the plug-in module due to the recessing of the leaves so as to permit a module to be connected to any other module of a set of modules, without removal of any module that would otherwise be necessary if the leaves were deflected past the side surface of the plug-in module.

27. A plug-in module as defined in claim 26, wherein the plural spring leaves oppose one another and extend outwardly from the plug-in module in the same direction, and with the plug-in module including an interior, the interior of the plug-in module incorporating a gear train including a drive shaft, the drive shaft being accessible on a first of the plurality of rigid side surfaces of the plug-in module, that is located between two of the at least two spring leaves, the drive shaft being provided with a first element of a dog clutch; the gear train incorporating at least one output shaft, the output shaft being accessible through an opening provided in another side surface of the plug-in module, from the outside, and the output shaft being provided with the other element of the dog clutch, this other element of the dog clutch being connected with the first element of the dog clutch of another such plug-in module when the snap connection is made between the plug-in modules, so as to produce a force-transmitting connection.

28. The plug-in module of claim 27 wherein spring leaves are located oh the first side surface where the drive shaft is located and snap ridges are located on the other side surface containing the opening for the output shaft.

* * * * *